United States Patent [19]

Young

[11] Patent Number: 4,654,150

[45] Date of Patent: Mar. 31, 1987

[54] APPARATUS AND METHOD FOR REMOVING COMBUSTIBLES FROM DRILL CUTTINGS

[75] Inventor: Neil E. Young, Skillman, N.J.

[73] Assignee: Associated Oiltools, Inc., Houston, Tex.

[21] Appl. No.: 765,060

[22] Filed: Aug. 12, 1985

[51] Int. Cl.[4] ..... B01D 35/18

[52] U.S. Cl. ..... 210/774; 210/180; 159/2.2; 159/47.1; 219/421; 175/206; 425/376 R; 425/378 R

[58] Field of Search ..... 210/774, 180; 55/208, 55/42, 190, 194, 200; 219/421; 159/2.2, 47.1; 175/66, 206; 425/376 R, 378 R; 264/176 R; 110/250

[56] References Cited

U.S. PATENT DOCUMENTS

| | | | |
|---|---|---|---|
| 2,198,703 | 4/1940 | Lawyer | 219/421 |
| 2,366,417 | 1/1945 | MacMillin | 425/376 A |
| 2,797,767 | 7/1957 | Brooke et al. | 55/194 |
| 3,031,030 | 4/1962 | Rodenacker | 55/190 |
| 3,112,191 | 11/1963 | Anderson | 55/194 |
| 3,354,501 | 11/1967 | Bachman et al. | 425/378 |
| 3,570,420 | 3/1971 | Lewis | 110/8 |
| 4,139,462 | 2/1979 | Sample, Jr. | 210/72 |
| 4,208,285 | 6/1980 | Sample | 210/180 |
| 4,304,609 | 12/1981 | Morris | 134/19 |
| 4,313,785 | 2/1982 | Schellstede | 159/6 W |
| 4,462,470 | 7/1984 | Alexander et al. | 175/66 |

*Primary Examiner*—Bernard Nozick

*Attorney, Agent, or Firm*—Tarolli, Sundheim & Covell

[57] ABSTRACT

Apparatus and method for removing combustibles from drill cuttings are provided wherein the drill cuttings are forced under pressure through an extrusion section having no moving parts. The extrusion section comprises a fixed mandrel coaxial with an outer cylindrical shell and having a thin annular chamber therebetween for heating the drill cuttings passing through the extrusion section. The drill cuttings then enter a separating means for removing the volatile combustibles from the solid drill cuttings.

10 Claims, 3 Drawing Figures

APPARATUS AND METHOD FOR REMOVING COMBUSTIBLES FROM DRILL CUTTINGS

FIELD OF INVENTION

The present invention relates to an apparatus and method for removing combustibles, such as hydrocarbons from materials such as oil well drill cuttings, oil field waste, garbage, etc.

BACKGROUND OF INVENTION

Apparatus and methods for removal of combustibles, such as hydrocarbons from materials are known and have a variety of uses. For example, drilling fluids are used to remove drill cuttings during rotary drilling of various subterranean wells, such as oil wells. These drilling fluids are oil based. Solids control equipment is used on the surface to remove the cuttings from the drilling fluid returned to the surface with the cuttings. The drill cuttings become impregnated with the oil based drilling fluids. Disposal of oil impregnated cuttings is a problem because of strict pollution regulations and laws.

One solution for disposal of oil impregnated drill cuttings is to submit the drill cuttings to combustion under controlled conditions. See Lewis U.S. Pat. No. 3,570,420. Another, more recent solution is to heat the drill cuttings under controlled conditions to separate the combustible products, such as gaseous hydrocarbons, from the solid drill cuttings. See Schellstede U.S. Pat. No. 4,313,785, Morris U.S. Pat. No. 4,304,609 and Sample U.S. Pat. No. 4,139,462. However, each of these more recent designs utilizes an auger rotating within a heated tube. The auger type of design, however, involves several problems, including one or more of the following: limited pumping pressure, seal failures on the auger bearings, alignment problems between the auger and the heated tube causing galling of the inner surface of the heated tube, and retarded flow or plugging of drill cuttings between the auger and the heated tube.

SUMMARY OF INVENTION

The problems of using an auger type design as noted above are minimized in accordance with the present invention. The present invention is an apparatus and a method for removing combustibles from materials by using a specially designed extrusion section and no rotating auger. The extrusion section comprises a cylindrical shell and a mandrel coaxially fixed therein. This avoids any moving parts in the heating and extrusion section. The mandrel is spaced from the cylindrical shell to form a thin annular chamber therebetween. The material, such as drill cuttings, is forced through this thin annular chamber by a suitable pump.

The extrusion section is heated to a sufficient degree to volatilize any combustibles contained on or in the material. The material is introduced into the extrusion section by a high pressure pump, such as a high pressure concrete pump. The material is pumped through the extrusion section under pressure, and heating means vaporizes the combustibles contained in the material.

The heated drill cuttings are then introduced into a separator means. The separator chamber is maintained at a lower pressure than the extrusion section, thus allowing the volatilized combustibles to be separated from the solids upon release into the separator means.

The solids drop into a water bath which also acts as a water seal to prevent the escape of gaseous components. The solids are cooled and removed by a processing conveyor. The gaseous combustibles are contained by a hood and may be flared or otherwise treated, such as by a condenser.

The apparatus and method of the present invention avoid the use of any moving parts in the extrusion section. In addition, the apparatus and method of the present invention avoid high pressure seals and represent a simple and economical design.

DESCRIPTION OF PREFERRED EMBODIMENT

Figure 1:
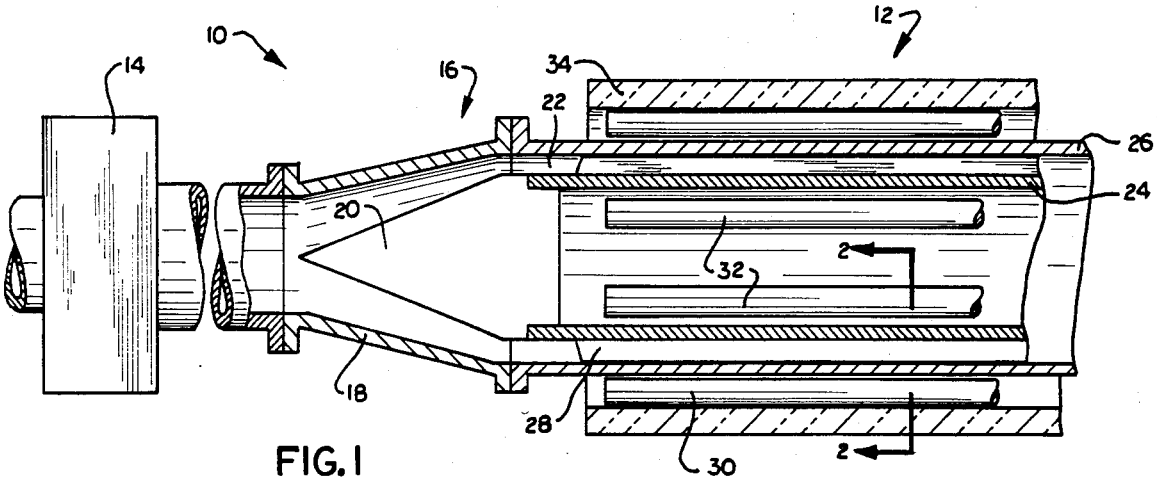
FIG. 1 is a partial horizontal cross sectional view of the apparatus of the present invention.

A horizontal cross sectional view of part of the apparatus in accordance with the present invention is illustrated in FIG. 1. The invention is described herein as applied to the removal of hydrocarbons from drill cuttings. Drill cuttings containing oil based components, such as diesel oil, are pumped by a high pressure pump 14 under a pressure sufficient to move the drill cuttings through an extrusion section 12. The pump 14 must be capable of generating sufficient pressure to force the drill cuttings through the extrusion section 12. Pressures up to 5,000 psi may be necessary. The preferred pump is a known high pressure concrete pump.

The drill cuttings from the output of the pump 14 enter a diffusion section 16 which consists of a conically flared wall 18 and a conically shaped diffuser cone 20. The diffuser section 16 directs the drill cutting material into a thin annular section 22. The thin annular section 22 is spaced between a fixed mandrel 24 and an outer cylindrical tube or shell 26. The conically shaped diffuser 20 is secured to the upstream end of the fixed mandrel 24.

Figure 2:
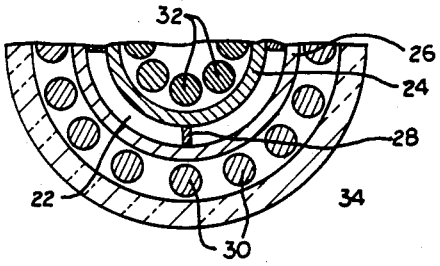
FIG. 2 is a cross sectional view along line 2—2 of FIG. 1.

The fixed extruder mandrel 24 is secured to and spaced from the cylindrical shell 26 by appropriately spaced supporting fins 28. The thin annular space 22 and the supporting fins 28 are more clearly shown in the partial cross sectional view of FIG. 2. A sufficient manufacturing clearance between the fins 28 and the shell 26 may be provided to permit easy insertion and removal of the mandrel 24. Of course, any suitable type of supporting and spacing means can be used to maintain the annular space 22 between the fixed mandrel 24 and the outer tubular shell 26. For example, the fins 28 could be slightly helical along the length of the mandrel to prevent any drill cuttings from quickly traversing the extrusion section due to the propulsion of solid particles by vapor explosions. The mandrel 24 and the tubular shell 26 are fixed with respect to one another and are concentric with one another. Thus, the drill cuttings moving through the extrusion section 22 do not encounter any moving parts, and the sole transporting force is the force of the pump 14.

The extrusion section 12 is also provided with a suitable heating means to volatilize the combustible components in the drill cuttings. (As used herein, the term "combustible" includes any oil based components of the drilling fluid, e.g., diesel oil, as well as hydrocarbons, and other volatile materials capable of sustaining combustion.) Under high pressure and heat, the volatile components adhered to or contained in the drill cuttings will be driven out of the solid drill cuttings. One type of suitable heating means is a series of electric resistance heating wires. Diesel or gas fired heat sources may be used. In the illustrated embodiment, one series of electric heating wires 30 is contained around the outside of the cylindrical shell 26, and another series of electric heating wires 32 is contained within the fixed mandrel 24. The first series of electric heating wires 30 transmits heat to the outer surface of the cylindrical shell 26 and then to the drill cuttings contained in the thin annular chamber 22. The inner series of electric wires 32 transfers heat to the fixed mandrel 24 and then to the drill cuttings contained in the thin annular space 22. Other suitable heating means could also be employed for purposes of the present invention. An insulation layer 34 is provided around the outside of the outer series of electric wires 32 to minimize unnecessary heat loss to the surrounding area.

Figure 3:
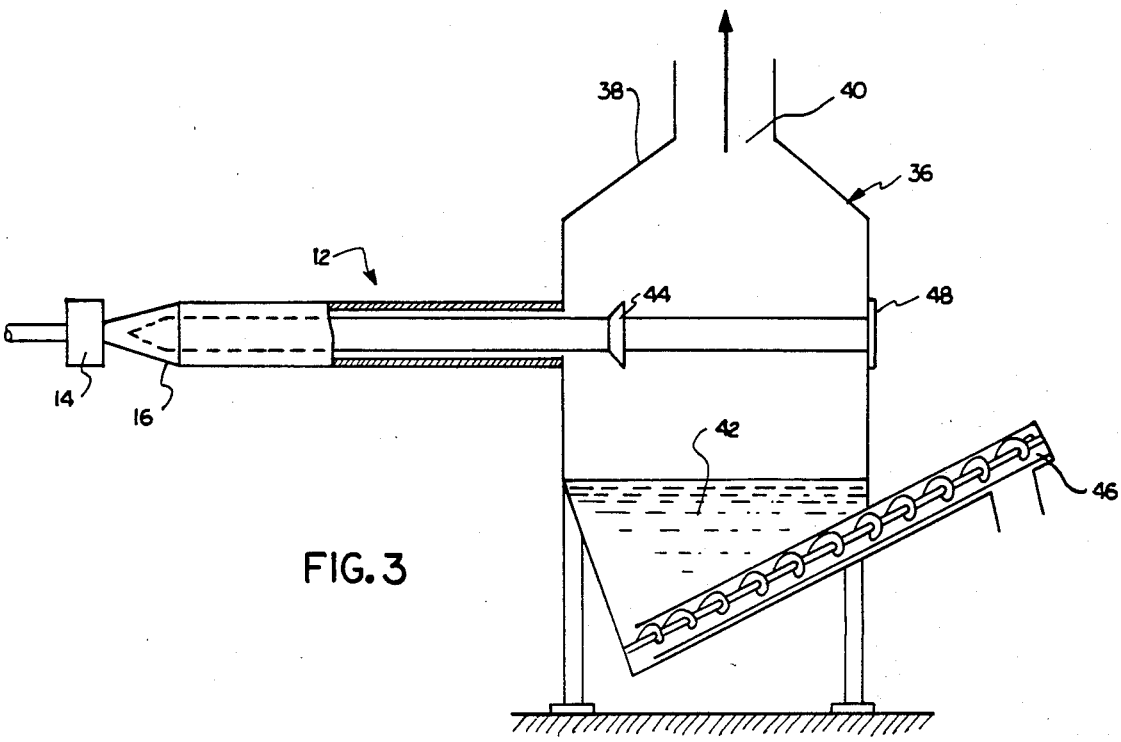
FIG. 3 is a schematic view of the entire apparatus and method of the present invention.

As the drill cuttings move through the extrusion section 12, the combustible components contained in the drill cuttings are volatilized. Although the heating and extrusion section volatilizes the combustible components, the combustible components remain trapped in a gas/solid mixture because of the pressure within the extrusion section. As the pump 14 forces new drill cuttings into the extrusion section 12, heated drill cuttings exit the other end of the extrusion section 12 into a separating means 36 (FIG. 3). The separating means 36 is maintained at a lower pressure than the extrusion section 12. By maintaining the separating chamber or means 36 at a lower pressure, the volatile components which were under pressure in the extrusion section 12 now quickly become liberated as the heated drill cuttings enter the separating means 36. The gaseous combustible components are confined within the separating means 36 by a hood 38. The separated combustibles then exit an outlet 40 to be burned in a flare or sent to other processing means such as a condenser. Alternatively, the separated combustibles could be reburned to generate heat which may be used to heat the materials in the space 22.

The extrusion section is sized according to the available pumping force and heat. The object is to heat the center of the flow of the drill cuttings to about 600° F. to insure volatilization of all the combustible components. Depending on (i) the speed of the drill cuttings flowing through the extrusion section and (ii) the available heat, the diameter of the extrusion section, the thickness of the annular flow chamber and the length of the extrusion section can be determined.

The drill cuttings from which the combustible materials have been removed fall into a water bath 42 at the bottom of the separating means 36. The water bath 42 not only cools the drill cuttings but also acts as a water seal to prevent the escape of gaseous materials from the separating chamber 36 except through outlet 40. In the event that some of the dried drill cutting materials adhere to the fixed mandrel, a collar or cuttings breaker 44 may be provided to force the drill cuttings from traveling along the fixed mandrel under the pressure of the pump 14. The cooled drill cuttings may be removed from the separating mechanism 36 by an auger 46 which transports the drill cuttings from the bottom of the separating mechanism to another area or apparatus for further processing or disposal. Access to the fixed extruder may be obtained through an opening 48.

The heated extrusion section 12 of the present invention avoids the moving auger of prior art designs and in fact does not use any moving parts at all in the heated area. The apparatus of the present invention and the accompanying method also avoid the need to use any high pressure seals. In addition, the apparatus and method of the present invention utilize fewer parts and ordinary materials, therefore resulting in reduced apparatus and processing costs. Other advantages include reduced operating supervision and reduced weight.

What is claimed is:

1. A process for separating combustibles from a material comprising:

pumping the material under pressure through an annular chamber formed between a cylindrical shell and a mandrel fixed therein in a spaced relationship thereto;

heating the material in the annular chamber as the material is moved therethrough to evaporate the combustibles; and separating gaseous combustibles from solids.

2. A process as claimed in claim 1 wherein said heating is accomplished by heating said mandrel and said cylindrical shell.

3. A process as claimed in claim 1 wherein said material is maintained under pressure in said annular chamber and is introduced into a separating means at a lower pressure to allow gaseous combustibles to expand and separate from solids.

4. Apparatus for separating combustibles from drill cuttings comprising:

means defining an annular chamber through which the drill cuttings move, means for pumping the cuttings into the chamber and forcing the cuttings through the chamber, and means for heating the cuttings as they move through the chamber to evaporate combustibles from the drill cuttings, said means defining said annular chamber comprising a cylindrical shell and a fixed mandrel coaxial therewith located in said shell.

5. Apparatus for separating combustibles from material comprising:

means for pumping the material containing the combustibles;

means connected to said means for pumping for extruding the material, said means for extruding comprising a cylindrical shell and a mandrel fixed therein, said mandrel being spaced from said shell to form a thin annular chamber for receiving the material from said means for pumping;

means for heating said means for extruding to evaporate the combustibles; and separator means connected to said means for extruding for separating gaseous combustibles and solids, said separator means containing a water bath seal and an auger to remove solids from said separator means.

6. Apparatus for separating combustibles from a material including:

a cylindrical shell;

a mandrel fixed in said cylindrical shell in a spaced relationship thereto to form an annular chamber therebetween;

pump means for pumping the material through said annular chamber;

heating means for heating the material as it is moved through the annular chamber to evaporate the combustibles; and separator means connected to said annular chamber for separating the gaseous combustibles from solids.

7. Apparatus as claimed in claim 6 wherein said means for heating comprises first means for heating said mandrel and second means for heating said cylindrical shell.

8. Apparatus as claimed in claim 7 wherein both said first and second means for heating are electrical resistance heating wires.

9. Apparatus as claimed in claim 6 wherein said pump means for pumping places said material under pressure in said annular chamber, and said separator means having means maintained at a pressure lower than the pressure in said annular chamber to allow gaseous combustibles to expand and separate from solid material.

10. Apparatus as claimed in claim 6 wherein said mandrel contains means for removing solid material therefrom after the material have exited the means chamber.

* * * * *